United States Patent [19]

Hotta et al.

[11] Patent Number: 4,764,457

[45] Date of Patent: Aug. 16, 1988

[54] SILVER HALIDE PHOTOGRAPHIC EMULSION

[75] Inventors: Yuji Hotta, Hachioji; Syoji Matsuzaka, Hino; Masanobu Miyoshi, Odawara, all of Japan

[73] Assignee: Konishiroku Photo Industry Co., Ltd., Tokyo, Japan

[21] Appl. No.: 111,127

[22] Filed: Oct. 15, 1987

Related U.S. Application Data

[63] Continuation of Ser. No. 052,125, May 15, 1987, abandoned, which is a continuation of Ser. No. 857,403, Apr. 21, 1986, abandoned, which is a continuation of Ser. No. 677,203, Dec. 3, 1984, abandoned.

[30] Foreign Application Priority Data

Aug. 17, 1981 [JP] Japan ..... 56-129254

[51] Int. Cl.[4] ..... G03C 1/02; G03C 1/06

[52] U.S. Cl. ..... 430/569; 430/603; 430/604

[58] Field of Search ..... 430/603, 604, 569

[56] References Cited

U.S. PATENT DOCUMENTS

| | | | |
|---|---|---|---|
| 1,574,944 | 3/1926 | Sheppard | 430/603 |
| 1,623,499 | 4/1927 | Sheppard et al. | 430/603 |
| 1,742,042 | 12/1929 | Matthies et al. | 430/603 |
| 2,399,083 | 4/1946 | Waller et al. | 430/603 |
| 2,410,689 | 1/1946 | Sheppard et al. | 430/603 |
| 2,540,085 | 2/1951 | Baldsiefen et al. | 430/603 |
| 3,297,447 | 1/1967 | McVeigh | 430/599 |
| 3,320,069 | 5/1967 | Illingsworth | 430/603 |
| 3,901,714 | 8/1975 | Oftedahl | 430/604 |
| 3,957,491 | 5/1976 | Ohi et al. | 430/603 |
| 4,054,457 | 10/1977 | Bigelow | 430/600 |
| 4,067,740 | 1/1978 | Bigelow | 430/603 |
| 4,092,171 | 5/1978 | Bigelow | 430/604 |
| 4,173,483 | 11/1979 | Habu et al. | 430/603 |
| 4,221,863 | 9/1980 | Overman et al. | 430/569 |
| 4,284,717 | 8/1981 | Toya et al. | 430/603 |
| 4,332,887 | 6/1982 | Gerber | 430/567 |

FOREIGN PATENT DOCUMENTS

| | | | |
|---|---|---|---|
| 53-82408 | 7/1978 | Japan | 430/603 |

*Primary Examiner*—Mukund J. Shah
*Attorney, Agent, or Firm*—Jordan B. Bierman

[57] ABSTRACT

A silver halide photographic emulsion is disclosed. The emulsion has silver halide grains that consist essentially of silver chlorobromide and which have been sulfur-sensitized in the presence of a silver halide solvent.

11 Claims, No Drawings

SILVER HALIDE PHOTOGRAPHIC EMULSION

This application is a continuation of application Ser. No. 052,125, filed May 15, 1987, now abandoned, which is a continuation of application Ser. No. 857,403, filed 4/21/86, now abandoned, which is a continuation of application Ser. No. 677,203, filed 12/3/84.

This application claims the priority of application Ser. No. 677,203, filed Dec. 3, 1984, which claims the priority of application Ser. No. 406,853, filed Aug. 9, 1982, which claims the priority of Japanese No. 129,254/81, filed Aug. 17, 1981.

FIELD OF THE INVENTION

The present invention relates to chemically sensitized silver chlorobromide photographic emulsions.

BACKGROUND OF THE INVENTION

Silver chlorobromide photographic emulsions have better developability than silver iodobromide emulsions and are conventionally used in printing photosensitive materials or color paper. Since they have low sensitivity, silver chlorobromide emulsions must be used in large grains to achieve higher sensitivity, but increased grain size impairs their graininess and developability.

Chemical sensitization is commonly used to increase the sensitivity of silver halide photographic emulsions, and conventional methods of chemical sensitization include sulfur sensitization, gold sensitization and reduction sensitization which are generally used either alone or in combination. It is known that the combination of sulfur sensitization and gold sensitization achieves a higher sensitivity than sulfur sensitization alone, but this combination is not practical for the purpose of sensitizing silver halide photographic emulsions substantially made of silver chlorobromide since excess fog results. Therefore, it has long been desired to develop a method of sulfur sensitization that can effectively sensitize silver chlorobromide photographic emulsions without the help of gold sensitization.

SUMMARY OF THE INVENTION

One object of the present invention is to provide a silver chlorobromide photographic emulsion that has high sensitivity and less fog.

Another object of the invention is to provide a method for chemical sensitization of a silver chlorobromide photographic emulsion having such improved characteristics as described.

These objects of the present invention can be achieved by a silver halide photographic emulsion having silver halide grains that consist essentially of silver chlorobromide and which have been sulfur-sensitized in the presence of a silver halide solvent.

DETAILED DESCRIPTION OF THE INVENTION

The silver halide solvent used in the present invention is selected from among the compounds that react with silver halides to form water-soluble silver salts, and if sulfur-containing compounds are used, they should not form silver sulfide. Preferred examples are ammonium thiocyanate or alkali metal salts of thiocyanic acid (e.g. potassium thiocyanate and sodium thiocyanate) and thiourea derivatives (i.e. tetra-substituted ureas such as tetramethyl thiourea that does not form silver sulfide upon reaction with silver salts). Other suitable examples are compounds which are capable of forming complexes with silver halides, and they include ammonia, amine derivatives (e.g. triethylenetetramine), nitrogen-containing heterocyclic compounds such as pyridine and imidazole, as well as derivatives thereof.

Typical but by no means limiting examples of the silver halide solvent used in the present invention are listed below.

KNCS (1)

NaNCS (2)

$NH_4NCS$ (3)

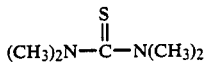
(4)

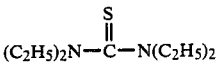
(5)

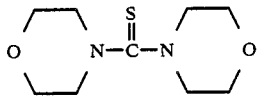
(6)

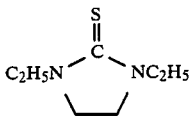
(7)

$NH_3$ (8)

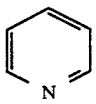
(9)

$(C_2H_5)_3N$ (10)

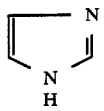
(11)

The silver halide solvent used in the present invention may be added before or during the chemical ripening of silver chlorobromide photographic emulsions. The solvent may be added in admixture with a sulfur sensitizer but more preferably the solvent and sulfur sensitizer are added separately, and the order of their addition is not critical. The amount of addition of the silver halide solvent varies widely with the solvent type and the intended effect of its addition, and generally, the solvent is used in an amount ranging from about $1\times10^{-5}$ to $1\times10^{-1}$ mole per mole of silver chlorobromide, and preferably, it is used in an amount of about $1\times10^{-4}$ to $1\times10^{-2}$ mole per mole of silver chlorobromide.

The sulfur sensitizer used in the present invention is selected from among the compounds that react with silver halides to form silver sulfide eventually. Suitable sulfur sensitizers include thiosulfates (e.g. sodium thiosulfate), thiazoles, rhodamines and thioureas. These compounds are generally used in an amount of from $10^{-4}$ to $10^{-6}$ mole per mole of silver halide but the exact amount varies with their type.

According to the present invention, chemical sensitization may be combined with reduction sensitization. A suitable method of reduction sensitization is by silver ripening or by using a reduction sensitizer. Suitable reduction sensitizers include stannous salts, amines, hydrazine derivatives, formamidine sulfinic acids and silane compounds. Reduction sensitization with these compounds may be effected on the surface or in the interior of silver halide grains. For the objects of the present invention, chemical sensitization is effected at a pH in the range of from 4 to 9. The sensitization temperature ranges generally from 40° to 80° C., preferably from 40° to 60° C.

The silver halide grains used in the present invention consist essentially of silver chlorobromide, and for the purposes of providing increased developability and sensitivity and lessening fog, the grains preferably contain at least 50 mol% of silver bromide, not more than 2 mol% of silver iodide and at least 0.5 mol% of silver chloride. The average size of the silver chlorobromide grains in the emulsion (as measured by the diameter if the grains are spherical or pseudo-spherical, and the length of one side if the grains are cubic, and both expressed in terms of the projected area) is not critical but the preferred value is not more than 3 microns. The grain size distribution may be narrow or broad. The silver chlorobromide grains in the photographic emulsion may have regularly shaped, say, cubic or octahedral, crystals, or they may have irregularly shaped, say, spherical or tabular, crystals. Alternatively, the crystals may be combinations of these shapes. The grains may be a mixture of those having various crystal shapes. The grains may have different phases between the interior and the surface, or they may consist of a uniform phase.

The photographic emulsion of the present invention can be prepared by any of the methods described in P. Glafkides; "Chimie et Physique Photographique", Paul Montel, 1967, G. F. Duffin; "Photographic Emulsion Chemistry", The Focal Press, 1966 and V. L. Zelikman et al.; "Making and Coating Photographic Emulsion", The Focal Press, 1964. That is, the emulsion may be prepared by acid process, neutral process or ammonia process. Soluble silver salts may be reacted with soluble halide salts by the single-jet method, double-jet method or their combination. The "reverse mixing method" wherein silver halide grains are formed in the presence of excess silver ions may also be used. The "controlled double-jet method" wherein the solution for forming silver halide grains is kept at a constant level of pAg may be used, and this method is effective for producing a silver halide emulsion comprising grains of a substantially uniform size having regular crystal shapes. The "conversion method" of the type described in U.S. Pat. No. 2,592,250 wherein silver salt grains having a higher solubility than silver bromide is first prepared and then at least one part of the grains is converted to a silver bromide salt may be used in the present invention. But more preferably, the silver chlorobromide emulsion is prepared without using such conversion method. Two or more silver halide emulsions that have been prepared separately may be combined. The silver halide grains may be formed or the produced silver halide grains may be ripened physically in the presence of cadmium salts, zinc salts, lead salts, thallium salts, iridium salts or their complex salts, as well as rhodium salts or their complex salts, and iron salts or their complex salts.

The photographic emulsion of the present invention may be sensitized spectrally with methine dyes or the like. Suitable dyes include cyanine dyes, merocyanine dyes, complex cyanine dyes, complex merocyanine dyes, homopolar cyanine dyes, hemicyanine dyes, styryl dyes and hemioxonol dyes. Particularly advantageous dyes are cyanine dyes, merocyanine dyes and complex merocyanine dyes. These dyes may contain any of the basic heterocyclic nuclei usually contained in the cyanine dyes, such as the pyrroline nucleus, oxazoline nucleus, thiazoline nucleus, pyrrole nucleus, oxazole nucleus, thiazole nucleus, selenazole nucleus, imidazole nucleus, terrazole nucleus and pyridine nucleus. These nuclei may be fused to alicyclic hydrocarbon rings or aromatic hydrocarbon rings to form an indolenine nucleus, benzoindolenine nucleus, indole nucleus, benzoxazole nucleus, naphthoxazole nucleus, benzothiazole nucleus, naphthothiazole nucleus, benzoselenazole nucleus, benzoimidazole nucleus and quinoline nucleus. These nuclei may be substituted on the carbon atom.

The merocyanine dye or complex merocyanine dyes may contain five- or six-membered heterocyclic nuclei having a ketometylene structure, such as the pyrazoline-5-one nucleus, thiohydantoin nucleus, 2-thioxazolidine-2,4-dione nucleus, thiazolidine-2,4-dione nucleus, rhodanine nucleus and thiobarbituric acid nucleus. Useful sensitizing dyes are described in German Pat. No. 929,080, U.S. Pat. No. 2,231,658, U.S. Pat. No. 2,493,748, U.S. Pat. No. 2,503,776, U.S. Pat. No. 2,519,001, U.S. Pat. No. 2,912,329, U.S. Pat. No. 3,655,394 U.S. Pat. No. 3,656,959, U.S. Pat. No. 3,672,897, U.S. Pat. No. 3,694,217, British Pat. No. 1,242,588, and Japanese Patent Publication No. 14030/69. These sensitizing dyes may be used either alone or in combination. Sensitizing dyes are often used in combination for the purpose of supersensitization, as typically described in U.S. Pat. No. 2,688,545, U.S. Pat. No. 2,977,229, U.S. Pat. No. 3,397,060, U.S. Pat. No. 3,522,052, U.S. Pat. No. 3,527,641, U.S. Pat. No. 3,617,293, U.S. Pat. No. 3,628,964, U.S. Pat. No. 3,666,480, U.S. Pat. No. 3,679,428, U.S. Pat. No. 3,703,377, U.S. Pat. No. 3,769,301, U.S. Pat. No. 3,814,609, U.S. Pat. No. 3,837,862, British Pat. No. 1,344,281, and Japanese Patent Publication No. 4936/68.

The photographic emulsion of the present invention may also contain a material that achieves supersensitization which itself is not a spectral sensitizing dye or which is substantially unable to absorb visible light. Examples of such material are aminostilbene compounds substituted by a nitrogen-containing heterocyclic group (such as described in U.S. Pat. No. 2,933,390 and U.S. Pat. No. 3,635,721), aromatic organic acid formaldehyde condensates (such as described in U.S. Pat. No. 3,743,510), cadmium salts and azaindene compounds. The combinations of compounds described in U.S. Pat. No. 3,615,613, U.S. Pat. No. 3,615,641, U.S. Pat. No. 3,617,295 and U.S. Pat. No. 3,635,721 are particularly advantageous.

The photographic emulsion of the present invention may further contain various compounds for the purpose of providing higher sensitivity, contrast or achieving accelerated development, such as polyalkylene oxides or their derivatives like ether, ester and amino, thioether compounds, thiomorpholines, quaternary ammonium salt compounds, urethane derivatives, urea derivatives, imidazole derivatives and 3-pyrazolidones. Some suitable examples are described in U.S. Pat. No. 2,400,532, U.S. Pat. No. 2,423,549, U.S. Pat. No. 2,716,062, U.S. Pat. No. 3,617,280, U.S. Pat. No. 3,772,021 and U.S. Pat. No. 3,808,003. The silver halide photographic emulsion of the present invention may also contain an anti-foggant or stabilizer, suitable examples of which are listed in Product Licensing Index, Vol. 92, page 107, "Anti-foggant and Stabilizer".

The photographic emulsion of the present invention may contain a developing agent, suitable examples of which are listed in supra, Vol. 92, page 107–108, "Developing Agent".

The silver halide grains that make up the photographic emulsion of the present invention can be dispersed in colloid that can be hardened with various organic or inorganic hardeners. Suitable hardeners are listed in supra, Vol. 92, page 108, "Hardener". The photographic emulsion of the present invention may also contain coating aids, suitable examples of which are listed in supra, Vol. 92, page 108, "Coating Aid". The photographic emulsion of the present invention may further contain color couplers, suitable examples of which are listed in supra, Vol. 92, page 110, "Color Materials". The photosensitive material prepared from the photographic emulsion of the present invention may contain dyes in the photographic emulsion or other hydrophilic colloid layers as filter dyes or for various other purposes like anti-irradiation. Suitable dyes are listed in supra, Vol. 92, page 109, "Absorbing and Filter Dyes". The photographic emulsion may also contain antistatic agents, plasticizers, matting agents, wetting agents, UV absorbers, brightening agents and antiaerial foggants. The silver halide emulsion used in the present invention uses a vehicle selected from among those listed in supra, Vol. 92, page 108, "Vehicles".

The silver halide emulsion of the present invention is coated onto a support optionally with other photographic layers. Suitable coating methods are described in supra, Vol. 92, page 109, "Coating Procedures". Suitable supports are described in supra, Vol. 92, page 108, "Support". The silver halide photographic emulsion of the present invention finds utility in various applications, such as color positive emulsions, color paper emulsions, color negative emulsions, color reversal emulsions, emulsions for photographic materials for plate making (e.g. lith films), emulsions for photographic materials for CRT display, emulsions for X-ray photographic materials (especially for direct and indirect radiography using screens), emulsions for colloid transfer process (such as described in U.S. Pat. No. 2,716,059), emulsions for silver salt diffusion transfer process (such as described in U.S. Pat. No. 2,352,014, U.S. Pat. No. 2,543,181, U.S. Pat. No. 3,020,155 and U.S. Pat. No. 2,861,885), emulsions for color diffusion transfer process (such as described in U.S. Pat. No. 3,087,817, U.S. Pat. No. 3,185,567, U.S. Pat. No. 2,983,606, U.S. Pat. No. 3,253,915, U.S. Pat. No. 3,227,350, U.S. Pat. No. 3,227,551, U.S. Pat. No. 3,227,552, U.S. Pat. No. 3,415,644, U.S. Pat. No. 3,415,645, U.S. Pat. No. 3,415,646 and Research Disclosure, Vol. 151, No. 15162, pages 75–87, November 1976), emulsions for dye transfer process (such as described in U.S. Pat. No. 2,882,156), emulsions for silver dye bleach process (such as described in Freedman; "History of Color Photography", Chapter 24, American Photographic Publishers, 1944, and "British Journal of Photography", Vol. 111, pages 308–309, 1964), emulsions for direct positive photosensitive materials (such as described in U.S. Pat. No. 2,497,875, U.S. Pat. No. 2,588,982, U.S. Pat. No. 3,367,778, U.S. Pat. No. 3,501,306, U.S. Pat. No. 3,501,305, U.S. Pat. No. 3,672,900, U.S. Pat. No. 3,477,852, U.S. Pat. No. 2,717,833, U.S. Pat. No. 3,023,102, U.S. Pat. No. 3,050,395 and U.S. Pat. No. 3,501,307), emulsions for heat developable photosensitive materials (such as described in U.S. Pat. No. 3,152,904, U.S. Pat. No. 3,312,550, U.S. Pat. No. 3,148,122 and British Pat. No. 1,110,046), and emulsions for physically developable photosensitive materials (such as described in British Pat. No. 920,277 and British Pat. No. 1,131,238).

The photographic emulsion of the present invention is used for multi-layered color paper with particular advantage. Photographic materials for color paper are more sensitive to fog than other photographic materials, so the emulsion of the present invention that prevents fogging while achieving higher sensitivity is best suited for use in color paper.

The photosensitive material with a coating of the emulsion of the present invention is then exposed to form a photographic image. Any conventional method of exposure can be used, and many known light sources are applicable for this purpose, such as natural light, tungsten lamp, fluorescent lamp, mercury lamp, xenon arc lamp, carbon arc lamp, xenon flash lamp and CRT flying spot. The exposure time is from 1/1000 to 1 second long as is the usual case for cameras, or it may be as short as $1\times10^{-6}$ to $1\times10^{-9}$ second if a xenon flash lamp or CRT is used. An exposure time longer than 1 second may also be used. If necessary, a color filter may be used to modulate the spectrum of light for exposure. Other light sources include a laser, as well as objects that emit light when excited by electron beams. X-rays, gamma-rays and alpha-rays.

The photosensitive material made from the emulsion of the present invention can be processed by any of the known methods, such as those described in Product Licensing Index, vol. 92, page 110, "Processing".

The present invention is now described in greater detail by reference to the following examples which are given here for illustrative purposes only and are by no means intended to limit its scope.

EXAMPLE 1

A silver chlorobromide emulsion (90 mol% of silver bromide) comprising cubic grains having an average size of 0.6 microns was prepared by the controlled double-jet method wherein the pAg value was held at 5.5. The emulsion was divided into five equal portions ($E_1$ to $E_5$), and the compounds listed in Table 1 below were added to the respective portions in the amounts indicated in the same table. The mixtures were ripened at a pH value of 6.0 and 50° C. for 60 minutes, and the resulting emulsions were coated onto cellulose acetate supports to give a silver coating weight of 50 mg/100 $cm^2$ and a gelatin coating weight of 30 mg/100 $cm^2$. The coated samples were exposed to a tungsten lamp (400 lux) through an optical wedge for a period of 1/100 second, and developed with a black and white developing solution of the following composition at 20° C. for 5 minutes.

Developer formulation

| | |
|---|---|
| Hydroquinone | 9.0 g |
| Phenidone | 0.5 g |
| Potassium bromide | 4.0 g |
| Sodium sulfite | 80.0 g |
| KOH and water to make 1000 ml at pH 10.0 | |

TABLE 1

| Emulsion | Sulfur Sensitizer | Silver Halide Solvent | Relative Sensitivity | Dmin |
|---|---|---|---|---|
| $E_1$ | sodium thiosulfate 4 mg | — | 100 | 0.04 |
| $E_2$ | sodium thiosulfate 4 mg | potassium thiocyanate 50 mg | 320 | 0.01 |
| $E_3$ | sodium thiosulfate 4 mg | pyridine 50 mg | 150 | 0.03 |
| $E_4$ | sodium thiosulfate 4 mg | trimethyl-tetramine 50 mg | 150 | 0.04 |
| $E_5$ | sodium thiosulfate 4 mg | tetramethyl thiourea 40 mg | 250 | 0.02 |

The amounts of the additives indicated in Table 1 are based on 1 mol of Ag. The photographic sensitivities of the respective samples were measured at a given density (optical density: 0.1) higher than the fog density, and the minimum densities of the samples were also measured. The results are shown in Table 1. Sulfur sensitization in the presence of silver halide solvents (i.e. potassium thiocyanate and tetramethyl thiourea) achieved much higher sensitivities than sensitization with hypo alone. The table also shows that thiocyanate salts and tetra-substituted thiourea were particularly effective among the silver halide solvents.

EXAMPLE 2

A silver chlorobromide emulsion (80 mol% of silver bromide) comprising octahedral grains having an average size of 0.6 microns was prepared by the controlled double-jet method wherein the pAg value was held at 8.0. The emulsion was divided into six equal portions ($E_6$–$E_{11}$), and the compounds listed in Table 2 below were added to the respective portions in the amounts indicated in the same table. The mixtures were ripened at a pH value of 6.0 and 50° C. for 80 minutes, and the resulting emulsions were applied onto resin-coated paper supports to give a silver coating weight of 10 mg/100 $cm^2$ and a gelatin coating weight of 50 mg/100 $cm^2$, together with a Y-coupler (compound A indicated below) that was applied in a coating weight of 15 mg/100 $cm^2$. The coated samples were exposed to a tungsten lamp (400 lux) through an optical wedge for a period of 1/100 second, and processed by the following procedures with the following agents.

Y-coupler (compound A)

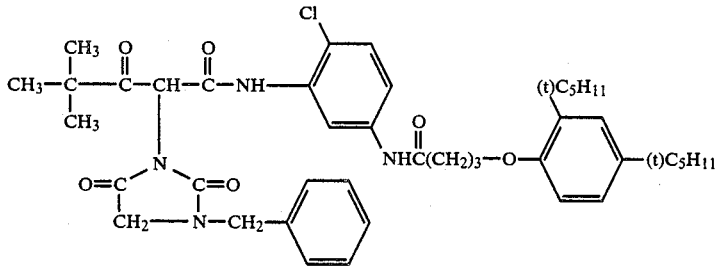

Processing steps

| | | |
|---|---|---|
| Color development | 30° C. | 3 minutes |
| Blixing | 30° C. | 2 minutes |
| Washing | 30° C. | 2 minutes |

Color developer

| | |
|---|---|
| Anhydrous sodium carbonate | 26 g |
| Anhydrous sodium bicarbonate | 3.5 g |
| Potassium sulfite | 1.8 g |
| Potassium bromide | 1.3 g |
| Sodium chloride | 0.2 g |
| Potassium hydroxide | 0.4 g |
| Hydroxylamine sulfate | 2.0 g |
| 4-Amino-3-methyl-N—ethyl-N—(β-methane-sulfonamidoethyl)-aniline | 5.0 g |
| Water to make 1000 ml (pH: 10.2) | |

Blixing solution

| | |
|---|---|
| Ammonium thio sulfate | 100 g |
| Potassium sulfite | 5 g |
| Na[Fe(EDTA)] | 40 g |
| EDTA | 4 g |
| Water to make 1000 ml | |

TABLE 2

| Emulsion | Sulfur Sensitizer | Silver Halide Solvent | Gold Sensitizer | Relative Sensitivity | Dmin |
|---|---|---|---|---|---|
| $E_6$ | sodium thiosulfate 6 mg | — | — | 100 | 0.01 |
| $E_7$ | sodium thiosulfate 6 mg | — | sodium chloro-aurate 2 mg | 250 | 0.48 |
| $E_8$ | allyl thiourea 10 mg | — | — | 90 | 0.02 |
| $E_9$ | sodium thiosulfate 6 mg | ammonium thiocyanate 50 mg | — | 400 | 0.02 |
| $E_{10}$ | sodium thiosulfate 6 mg | tetramethyl thiourea 25 mg | — | 320 | 0.0. |
| $E_{11}$ | allyl thiourea 10 mg | amnonium thiocyanate 50 mg | — | 320 | 0.02 |

The amounts of the additives indicated in Table 2 are based on 1 mol of Ag. The silver chlorobromide emulsion comprising octahedral grains could be effectively sensitized without fog according to the present invention.

EXAMPLE 3

Octadedral silver bromide gains having an average size of 0.3 microns were prepared by the controlled double-jet method wherein the pAg value was held at 8.0. Silver nitrate was added and the mixture was ripened at a pAg value of 3.0 and 60° C. for 60 minutes. A silver chlorobromide emulsion (80 mol % of silver bromide) comprising octahedral grains having an average size of 0.6 microns was prepared from the ripened mixture by the controlled double-jet method wherein the pAg value was held at 8.0. The emulsion was divided into three equal portions ($E_{12}$ to $E_{14}$), and 50 mg of a sensitizing dye (compound B indicated below) per mole of Ag, 100 mg of a stabilizer (compound C indicated below) per mole of Ag, and the compounds indicated in Table 3 below were added to the respective portions in the amounts indicated in the same table. The mixtures were ripened at 50° C. for 100 microns, and the resulting emulsions were applied to resin-coated paper supports to give a silver coating weight of 10 mg/100 $cm^2$ and a gelatin coating weight of 50 mg/100 $cm^2$, together with a mixture of M-coupler (compound D indicated below) in dibutyl phthalate with M-coupler protect-dispersed in aqueous gelatin (total M coupler coating weight: 30 mg/100 $cm^2$). The coated samples were exposed to green light through an optical wedge and subsequently processed as in Example 2.

Sensitizing dye (compound B)

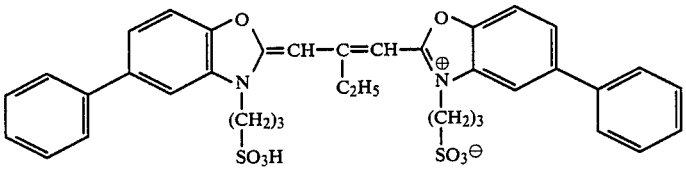

Stabilizer (compound C)

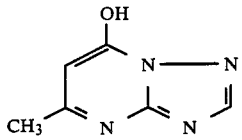

M-coupler (compound D)

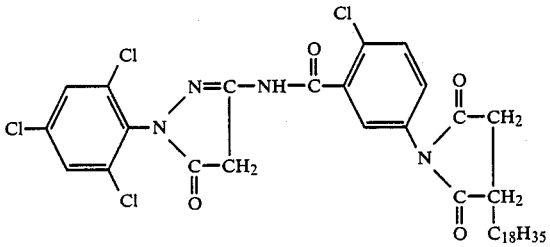

TABLE 3

| Emulsion | Sulfur Sensitizer | Silver Halide Solvent | Relative Sensitivity | Dmin |
|---|---|---|---|---|
| $E_{12}$ | sodium thiosulfate 5 mg | — | 100 | 0.01 |
| $E_{13}$ | sodium thiosulfate 5 mg | potassium thiocyanate 40 mg | 320 | 0.01 |
| $E_{14}$ | sodium thiosulfate 5 mg | tetramethyl thiourea 40 mg | 320 | 0.01 |

The amounts of the additives indicated in Table 3 are based on 1 mol of Ag. The table shows that the present invention was also effective for color-sensitized photographic materials.

EXAMPLE 4

A silver chlorobromide emulsion (180 mol% of silver bromide) comprising octahedral grains having an average size of 0.8 microns was prepared by the controlled double-jet method wherein the pAg value was held at 8.0. The emulsion was divided into two equal portions ($E_{15}$ and $E_{16}$). Octahedral silver chlorobromide grains (60 mol% of silver bromide) having an average size of 0.8 microns were prepared by the controlled double-jet method wherein the pAg value was held at 8.0 and "converted" to silver chlorobromide grains with a silver bromide content of 80 mol%, and the resulting emulsion was divided into two equal portions ($E_{17}$ and $E_{18}$). To the respective emulsions, 50 mg of a sensitizing dye (compound B indicated above) per mole of Ag, 10 mg of a stabilizer (compound C also indicated above) per mole of Ag, and the compounds listed in Table 4 below were added in the amounts indicated in the same table, and the mixtures were ripened at 50° C. for 90 minutes and applied to resin-coated paper supports as in Example 3. The so coated samples were exposed to green light through an optical wedge and subsequently processed as in Example 2.

TABLE 4

| Emulsion | Sulfur Sensitizer | Silver Halide Solvent | Relative Sensitivity | Dmin |
|---|---|---|---|---|
| $E_{15}$ | sodium thiosulfate 5 mg | — | 100 | 0.01 |
| $E_{16}$ | sodium thiosulfate 5 mg | potassium thiocyanate 50 mg | 320 | 0.01 |
| $E_{17}$ | sodium thiosulfate 5 mg | — | 125 | 0.01 |
| $E_{18}$ | sodium thiosulfate 5 mg | potassium thiocyanate 50 mg | 250 | 0.02 |

The amounts of the additives indicated in Table 4 are based on 1 mol of Ag. The advantage of the present invention was also apparent when the silver chlorobromide emulsion was prepared without using the conversion method.

What we claim is:

1. A silver halide photographic emulsion having silver halide grains consisting essentially of silver chlorobromide which have been sulfur-sensitized in the presence of a silver halide solvent selected from the group consisting of potassium thiocyanate, sodium thiocyanate, and ammonium thiocyanate, wherein said silver halide solvent is present in an amount of from about $1\times10^{-4}$ to about $1\times10^{-2}$ mole per mole of silver chlorobromide and said sulfur-sensitization is accomplished in the absence of a gold sensitizing compound.

2. The photographic emulsion of claim 1 wherein said sulfur sensitization takes place prior to or in admixture with the addition of said silver halide solvent to said emulsion.

3. The photographic emulsion of claim 2 wherein said silver halide grains consisting essentially of silver chlorobromide are prepared without using the conversion method.

4. The photographic emulsion of claim 2 wherein said silver halide grains consisting essentially of silver chlorobromide have reduced interior sensitivity.

5. The photographic emulsion of claim 2 wherein said silver halide grains have at least 50 mole % of silver bromide, not more than 2 mole % of silver iodide and at least 0.5 mole % of silver chloride.

6. The photographic emulsion of claim 2 wherein said silver halide grains consisting essentially of silver chlorobromide have an average crystal size of not more than 3 microns.

7. A photographic element comprising a photographic paper capable of producing a colored image having the photographic emulsion of claim 2 coated thereon.

8. The photographic emulsion of claim 4 wherein said silver halide grains consisting essentially of silver chlorobromide have an average crystal size of not more than 3 microns.

9. A photographic element comprising a photographic paper capable of producing a colored image having the photographic emulsion of claim 2 coated thereon.

10. A photographic element comprising a photographic paper capable of producing a colored image having the photographic emulsion of claim 4 coated thereon.

11. A photographic element comprising a photographic paper capable of producing a colored image having the photographic emulsion of claim 7 coated thereon.

* * * * *